US010612842B2

(12) United States Patent
Guerif et al.

(10) Patent No.: US 10,612,842 B2
(45) Date of Patent: Apr. 7, 2020

(54) LNG INTEGRATION WITH CRYOGENIC UNIT

(71) Applicant: L'Air Liquide, Societe Anonyme pour l'Etude et l'Exploitation des Procedes Georges Claude, Paris (FR)

(72) Inventors: Pierre-Philippe Guerif, Houston, TX (US); Louis DeBesombes, Sugar Land, TX (US); Michael A. Turney, Houston, TX (US); Oriane Farges, Houston, TX (US); Alain Guillard, Houston, TX (US)

(73) Assignee: L'Air Liquide Societe Anonyme Pour L'Etude Et L'Exploitation Des Procedes Georges Claude, Paris (FR)

( * ) Notice: Subject to any disclaimer, the term of this patent is extended or adjusted under 35 U.S.C. 154(b) by 132 days.

(21) Appl. No.: 15/815,154

(22) Filed: Nov. 16, 2017

(65) Prior Publication Data

US 2018/0142950 A1 May 24, 2018

Related U.S. Application Data

(60) Provisional application No. 62/423,978, filed on Nov. 18, 2016.

(51) Int. Cl.
*F25J 1/00* (2006.01)
*F25J 3/04* (2006.01)
(Continued)

(52) U.S. Cl.
CPC ..... *F25J 3/0615* (2013.01); *F25J 1/0022* (2013.01); *F25J 1/0052* (2013.01); *F25J 1/0221* (2013.01);
(Continued)

(58) Field of Classification Search
CPC ..... F25J 1/007; F25J 1/0072; F25J 2200/02; F25J 3/044; F25J 3/04406; F25J 3/04418;
(Continued)

(56) References Cited

U.S. PATENT DOCUMENTS 3,447,331 A 6/1969 Smith
4,843,829 A * 7/1989 Stuber ..... F25J 1/0025 62/54.2
(Continued)

FOREIGN PATENT DOCUMENTS

CN 10 157 1340 11/2009
EP 2 333 470 6/2011

OTHER PUBLICATIONS

Singh, Ravinder, et al., "Synergy of Large-Scale Cryogenic Air Separation Unit and Liquefied Natural Gas Import Terminal—Abstract," American Institute of Chemical Engineers Spring Meeting & 12th Global Congress on Process Safety, 2017.
(Continued)

*Primary Examiner* — Frantz F Jules
*Assistant Examiner* — Erik Mendoza-Wilkenfel
(74) *Attorney, Agent, or Firm* — Justin K. Murray

(57) ABSTRACT

A method for the production of liquefied natural gas (LNG) using a cold fluid provided from a cryogenic unit, such as an air separation unit or nitrogen liquefier, is provided. The method may include the steps of: withdrawing a nitrogen stream from a cryogenic unit, wherein the nitrogen stream is at a temperature between about −155° C. to about −193° C.; and liquefying a natural gas stream in a natural gas liquefaction unit using the nitrogen stream from the cryogenic unit.

7 Claims, 6 Drawing Sheets

(51) Int. Cl.

| | |
|---|---|
| ***F25B 9/06*** | (2006.01) |
| ***F25J 3/06*** | (2006.01) |
| ***F25J 1/02*** | (2006.01) |

(52) U.S. Cl.

CPC ..... *F25J 1/0234* (2013.01); *F25J 3/0409* (2013.01); *F25J 3/04018* (2013.01); *F25J 3/0426* (2013.01); *F25J 3/0429* (2013.01); *F25J 3/04036* (2013.01); *F25J 3/04145* (2013.01); *F25J 3/04175* (2013.01); *F25J 3/04224* (2013.01); *F25J 3/04296* (2013.01); *F25J 3/04412* (2013.01); *F25J 3/04563* (2013.01); *F25J 2210/42* (2013.01); *F25J 2210/62* (2013.01); *F25J 2215/60* (2013.01); *F25J 2230/20* (2013.01); *F25J 2230/30* (2013.01); *F25J 2270/04* (2013.01); *F25J 2270/14* (2013.01)

(58) Field of Classification Search

CPC .... F25J 3/04424; F25J 3/0443; F25J 3/04563; F25J 2210/40; F25J 1/0022; F25J 1/003; F25J 1/0047; F25J 1/005; F25J 1/0052; F25B 9/06

See application file for complete search history.

(56) References Cited

U.S. PATENT DOCUMENTS

| | | | | |
|---|---|---|---|---|
| 5,137,558 | A | 8/1992 | Agrawal | |
| 6,131,407 | A | 10/2000 | Wissolik | |
| 6,915,661 | B2 | 7/2005 | Le Bot | |
| 7,143,606 | B2 | 12/2006 | Tranier | |
| 7,197,894 | B2 | 4/2007 | Guillard et al. | |
| 7,219,512 | B1 | 5/2007 | Wilding et al. | |
| 2004/0083756 | A1* | 5/2004 | Tranier | F25J 1/0022 62/614 |
| 2014/0116084 | A1* | 5/2014 | Bonnissel | F25B 9/06 62/611 |

OTHER PUBLICATIONS

Smith, A.R., et al., "A review of air separation technologies and their integration with energy conversion processes," Fuel Processing Technology, 70, 2001, pp. 115-134.

Tuo, Hanfei, et al., "Exergy Analysis of Combined Cycle of Air Separation and Natural Gas Liquefaction," World Academy of Science, Engineering and Technology International Journal of Chemical, Molecular, Nuclear, Materials and Metallurgical Engineering, vol. 5, No. 1, 2011, pp. 77-83.

* cited by examiner

HEAT FLOW VS. TEMPERATURE FOR LIQUID NITROGEN AND LNG

HEAT FLOW VS. TEMPERATURE FOR LOW PRESSURE NITROGEN AND LNG

HEAT FLOW VS. TEMPERATURE FOR MEDIUM PRESSURE NITROGEN AND LNG WITH TURBINE BOOSTER

LNG INTEGRATION WITH CRYOGENIC UNIT

RELATED APPLICATIONS

This application claims priority to U.S. Provisional Application Ser. No. 62/423,978 filed on Nov. 18, 2016, which is hereby incorporated by reference in its entirety.

TECHNICAL FIELD OF THE INVENTION

The present invention relates to a new method and design for producing liquefied natural gas in a cost effective and efficient manner.

BACKGROUND OF THE INVENTION

Expectations are rising regarding the role of natural gas as a primary energy source. It is abundant, affordable, and effective for reducing $CO_2$ emissions compared to other fossil fuels.

The first step of the natural gas liquefaction process typically involves removal of impurities like dust, acid gases, helium, water, or heavy hydrocarbons (e.g., particularly those that would freeze prior to the natural gas liquefying). The natural gas is then condensed into a liquid by cooling it to a temperature as low as −162° C.

In previous methods for mid to large scale liquefaction of natural gas, a refrigerant loop (typically nitrogen or a mixed of hydrocarbons) is used. These methods usually have a low operating expense; however, the investment is high. For example, a closed loop nitrogen liquefier requires a significant number of pieces of equipment such as a cycle compressor, process gas coolers, two nitrogen turbo-expanders, a main heat exchanger and a nitrogen refrigerant storage. In cases where a small to very small Liquefied Natural Gas (LNG) production is desired and sufficient quantities of liquid nitrogen (LIN) are available nearby, one solution is to use the LIN as the cold medium to liquefy the natural gas in a dedicated exchanger. In this case, LIN is vaporized by heat transfer with the condensing natural gas stream. While this method of producing LNG has a low capital investment, the major drawback of this method is the high operating expense as the liquefaction of natural gas with liquid nitrogen is inefficient from a thermodynamics point of view. See FIG. 1, which shows the irreversible heat losses for liquefying natural gas against LIN in which the natural gas flow is 80 stpd at a pressure of 22 bara and the liquid nitrogen flow is 173 stpd at 4 bara.

As is clearly shown in FIG. 1, the irreversible heat loss, which is shown as the area between the two curves, is quite large. Moreover, there are other inefficiencies that should be taken into account when producing LIN and delivering it to the LIN to LNG site, such as boil-off and flash losses related to the LIN storage and LIN losses when loading or unloading the truck. Therefore, there is clearly a need for a method and device that would allow for a more efficient method of liquefying natural gas, particularly on a small scale compared to the methods described above.

SUMMARY OF THE INVENTION

The present invention is directed to a device and a method that satisfies at least one of these needs. Certain embodiments of the present invention relate to a method and apparatus for liquefaction of natural gas using a nitrogen stream from a nearby cryogenic source (e.g., Air Separation Unit or Nitrogen Liquefier). The nitrogen stream can either be a low pressure nitrogen stream (typically between 1 and 3 bar) or a medium pressure nitrogen stream (typically between 5 and 10 bar). These nitrogen streams are typically used to provide additional cooling for the incoming air to be separated, however, in certain embodiments of the present invention, at least a portion of one or both of these streams can be used to provide the necessary refrigeration for liquefying natural gas.

In one embodiment of the invention, a nitrogen rich stream is sourced from the medium pressure column of an Air Separation Unit ("ASU") and used to provide refrigeration to the natural gas to be liquefied. The nitrogen rich stream at medium pressure can be withdrawn from the natural gas liquefier, preferably at an intermediate section of the natural gas liquefier and then expanded in a nitrogen turbine to a lower pressure, preferably slightly above atmospheric pressure, before the now low pressure nitrogen rich stream is then reintroduced to the cold section of the natural gas liquefier to provide additional refrigeration. In a preferred embodiment, the natural gas feed can be compressed in a natural gas compressor. In another embodiment, the natural gas compressor is at least partially powered by the nitrogen turbine, thereby further reducing energy costs.

In another embodiment, the nitrogen rich stream is sourced from the low pressure column of the ASU. This low pressure nitrogen stream is preferably warmed in a subcooler of the ASU to bring the temperature of the low pressure nitrogen stream to a temperature that is above the freezing point of methane prior to liquefying the natural gas.

In one embodiment, a method for producing liquefied natural gas is provided. In this embodiment, the method can include the steps of: rectifying air in a double column system thereby producing a low pressure nitrogen stream, an oxygen stream, and a medium pressure nitrogen stream; introducing the medium pressure nitrogen stream to the natural gas liquefaction unit; withdrawing the medium pressure nitrogen stream from the natural gas liquefaction unit from an intermediate location; expanding the medium pressure nitrogen stream in a nitrogen turbine to form an expanded nitrogen stream; reintroducing the expanded nitrogen stream into the natural gas liquefaction unit to provide additional refrigeration to the natural gas; compressing a natural gas stream in a natural gas compressor; and liquefying the natural gas stream in a natural gas liquefaction unit against the medium pressure nitrogen stream and the expanded nitrogen stream, wherein the nitrogen turbine is coupled to the natural gas compressor.

In optional embodiments of the method for the production of LNG:

- the method can include the steps of withdrawing a nitrogen stream from a cryogenic unit, wherein the nitrogen stream is at a temperature between about −155° C. to about −193° C.; and
- liquefying a natural gas stream in a natural gas liquefaction unit using the nitrogen stream from the cryogenic unit;
- the cryogenic unit is selected from the group consisting of an air separation unit, a nitrogen liquefaction unit, and combinations thereof;
- the cryogenic unit comprises an air separation unit having a double column system configured to produce a low pressure nitrogen stream, an oxygen stream, and a medium pressure nitrogen stream;
- the nitrogen stream is selected from the group consisting of the low pressure nitrogen stream, the medium pressure nitrogen stream, and combinations thereof;

the step of liquefying the natural gas stream further comprises warming the medium pressure nitrogen stream in the natural gas liquefaction unit;

the step of liquefying the natural gas stream further comprises withdrawing the medium pressure nitrogen stream from the natural gas liquefaction unit from an intermediate location; expanding the medium pressure nitrogen stream in a nitrogen turbine to form an expanded nitrogen stream; and then reintroducing the expanded nitrogen stream into the natural gas liquefaction unit to provide additional refrigeration to the natural gas;

the method further includes the step of compressing the natural gas stream in a natural gas compressor prior to liquefying the natural gas stream in the natural gas liquefaction unit; and/or the nitrogen turbine is coupled to the natural gas compressor.

BRIEF DESCRIPTION OF THE DRAWINGS

These and other features, aspects, and advantages of the present invention will become better understood with regard to the following description, claims, and accompanying drawings. It is to be noted, however, that the drawings illustrate only several embodiments of the invention and are therefore not to be considered limiting of the invention's scope as it can admit to other equally effective embodiments.

DETAILED DESCRIPTION

While the invention will be described in connection with several embodiments, it will be understood that it is not intended to limit the invention to those embodiments. On the contrary, it is intended to cover all the alternatives, modifications and equivalence as may be included within the spirit and scope of the invention defined by the appended claims.

Figure 2:
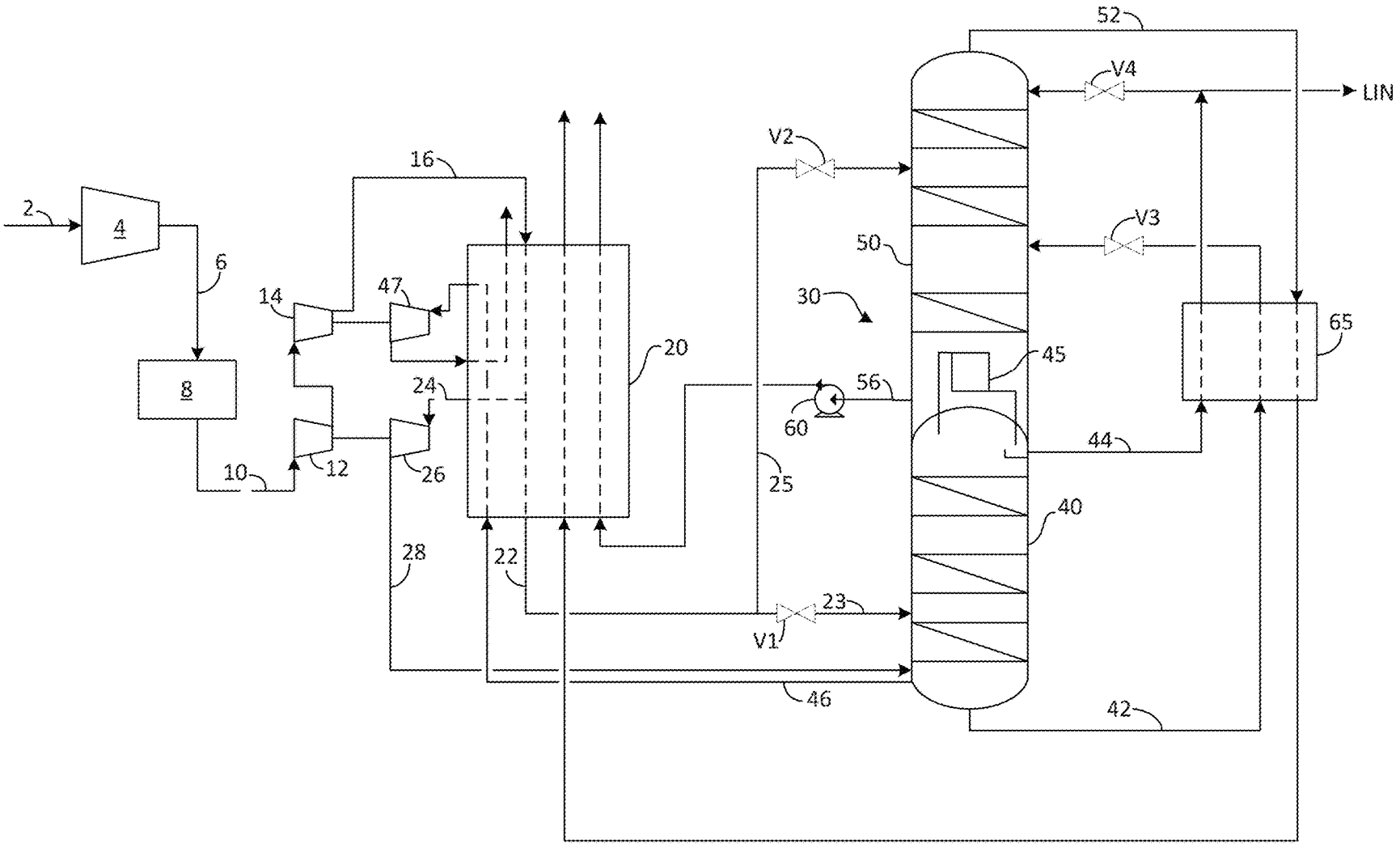
FIG. 2 provides a schematic representation of an Air Separation Unit in accordance with an embodiment of the present invention.

FIG. 2 provides a schematic view of an air separation unit in accordance with an embodiment of the present invention. Feed air 2 is compressed in main air compressor (MAC) 4 to produce compressed feed air 6, which is subsequently purified of water and carbon dioxide in purification unit 8 to produce dry air 10. In the embodiment shown, dry air 10 is sequentially compressed in booster compressors 12, 14 to a sufficient pressure to produce pressurized air 16. This pressurized air 16 is then introduced to the warm end of the main heat exchanger 20, wherein it is sufficiently cooled to produce cold feed air 22, which can be then sent to the double distillation column 30 via lines 23 and 25 to the medium pressure column 40 and the low pressure column 50, respectively.

In a preferred embodiment, a fraction of the pressurized air 24 is withdrawn from an intermediate location of main heat exchanger 20, expanded in air turbine 26 to and then fed to medium pressure column 40 via line 28. In the embodiment shown, air turbine 26 provides power to booster compressors 12.

Oxygen rich liquid 42 is withdrawn from a bottom section of medium pressure column 40, wherein it is subcooled in subcooler 65 before it is expanded in valve V3 and then introduced into low pressure column 50. Liquid nitrogen 44 can provide reflux for low pressure column 50 as well as provide liquid nitrogen product (LIN).

Purified liquid oxygen 56 is withdrawn from lower section of the low pressure column, pressurized in oxygen pump 60, and then vaporized in main heat exchanger to produce gaseous oxygen.

Low pressure nitrogen stream 52 can be withdrawn from the top of the low pressure column 50 where it provides subcooling in subcooler 65, and is then used to provide refrigeration for the incoming pressurized air 16 in main heat exchanger 20. Additional refrigeration for the system can be provided by withdrawing a fluid from medium pressure column 40 via line 46, where it is partially warmed before being withdrawn from an intermediate location of main heat exchanger 20, and then expanded in turbine 47 and then reintroduced to main heat exchanger 20 to provide additional refrigeration to the system. In a preferred embodiment, turbine 47 can provide power to booster compressor 14.

The low pressure nitrogen stream 52 typically contains small percentages of oxygen and argon and is at a pressure slightly above atmospheric pressure. In one embodiment, this low pressure nitrogen stream can be at a temperature close to −193° C. is typically sent to subcooler 65 to be warmed up to about −175° C. and then to the main heat exchanger to be warmed up to ambient temperature. Warm waste nitrogen can be used for the regeneration of the air separation unit dryers (e.g., purification unit 8) or at a chiller tower (not shown) to cool water.

Figure 3:
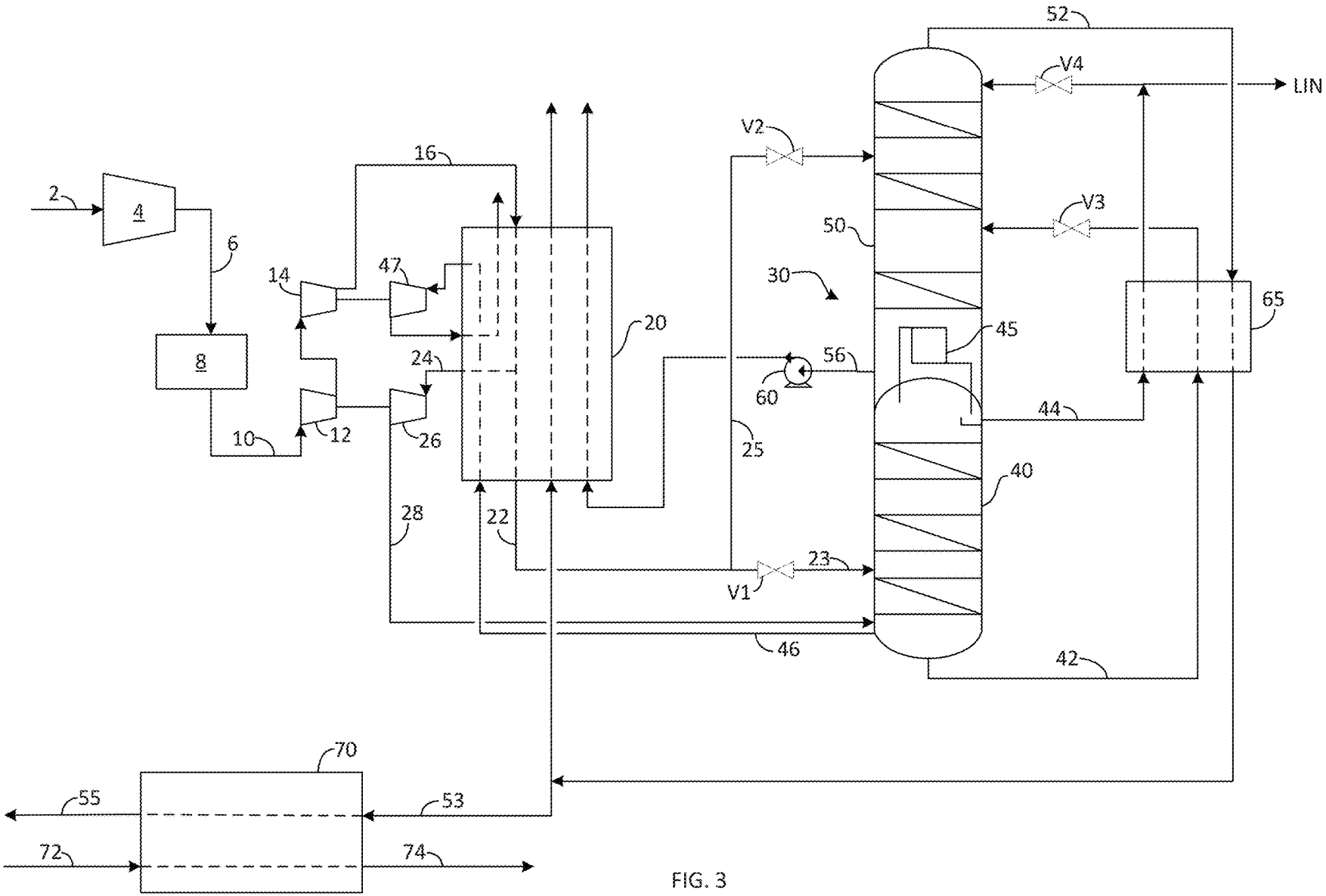
FIG. 3 provides a schematic representation of an embodiment of the present invention.

In one embodiment, shown in FIG. 3, at least a portion of the low pressure nitrogen 53 can be sent to a side LNG exchanger 70 instead of the main heat exchanger so that this cold stream is used to liquefy a natural gas feed 72 to produce liquefied natural gas (LNG) 74. In one embodiment, the portion of low pressure nitrogen 53 is at a temperature warmer than the freezing temperature of methane. This is preferably achieved by warming low pressure nitrogen stream 52 in subcooler 65. By using the portion of low pressure nitrogen 53 at a point downstream subcooler 65, risk of any hydrocarbon freezing within the natural gas stream is reduced significantly, while also yielding a more efficient temperature level for the liquefaction of natural gas.

In certain embodiments, this allows for coproduction of LNG with an Air Separation Unit with a low CAPEX as the natural gas liquefaction part is essentially just an exchanger that can be of the following types (non-exhaustive):

Brazed Aluminum

Spiral coil

Channeled plate

As such, certain embodiments of the invention do not require additional refrigerant storage or refrigerant pumps.

The low pressure gaseous nitrogen ("LPGAN") 55 exiting the side LNG exchanger 70 can be used for the regeneration of the natural gas purification (not shown), for the regeneration of the ASU purification (e.g., purification unit 8), and/or can be sent to the chiller tower of the ASU (not shown).

If the pressure available on the LPGAN stream is too low, then it is possible to add a blower at the warm end in order to overcome the pressure drop up to the atmosphere.

This option is applicable to all ASU process cycles as well as liquefiers when a cold enough stream is available.

Figure 4:
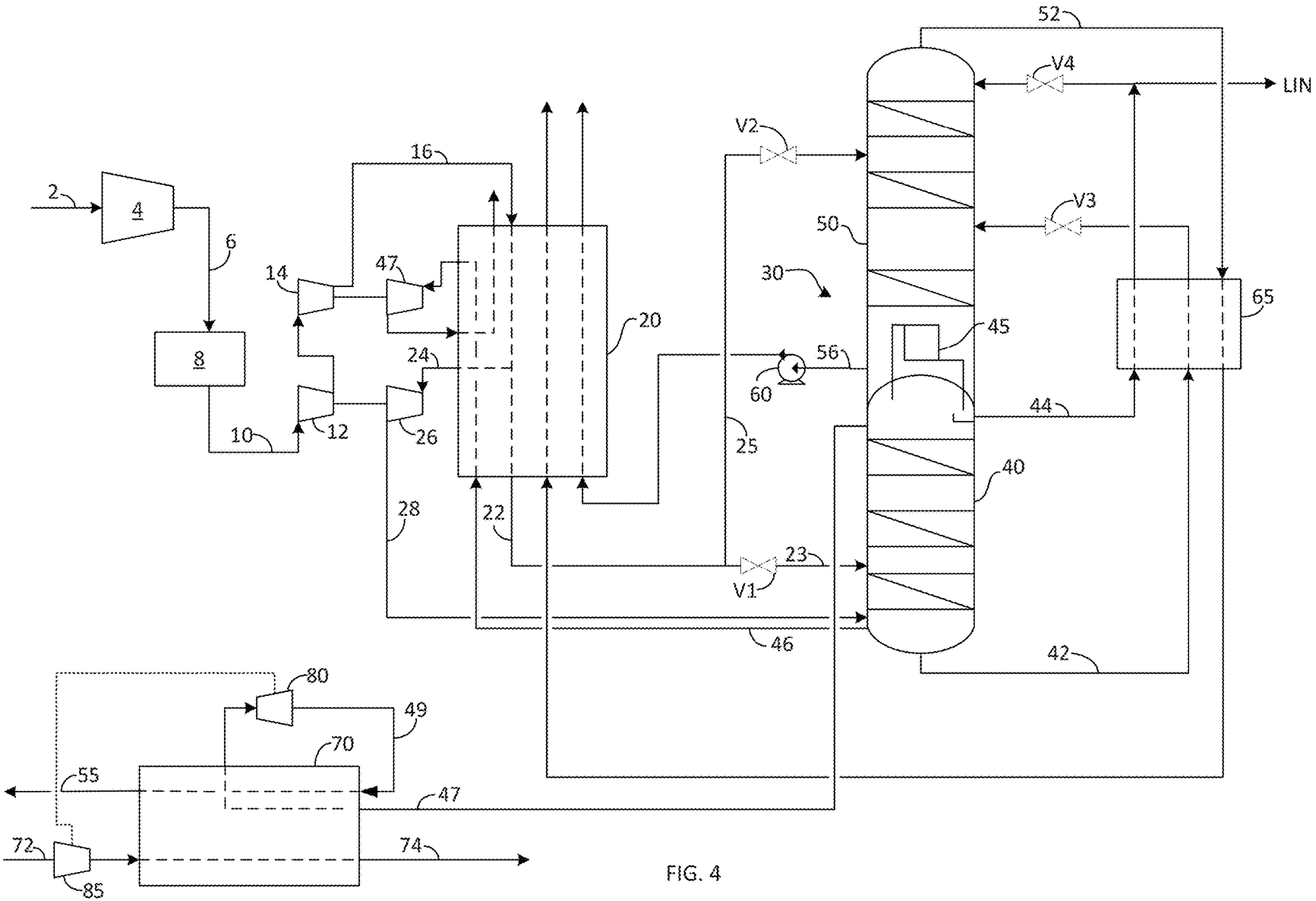
FIG. 4 provides a schematic representation of an embodiment of the present invention.

In another embodiment, shown in FIG. 4, medium pressure nitrogen 47 can be used to provide the cold medium. In one embodiment, medium pressure nitrogen 47 is a gaseous stream. In another embodiment, medium pressure nitrogen 47 is a liquid stream.

In a conventional Air Separation Unit, it is possible to produce medium pressure nitrogen containing traces of oxygen at typically 5 to 6 bara from the medium pressure column. Typically, this medium pressure nitrogen 47 is sent to the main heat exchanger to be warmed against the incoming air. However, in certain embodiments of the invention, at least a portion of the medium pressure nitrogen from the MP column can be sent to side LNG exchanger 70 instead of the main heat exchanger so that this cold stream is used to liquefy natural gas in the other passages of the side exchanger.

In one embodiment, further refrigeration potential can be extracted by withdrawing the medium pressure nitrogen at an intermediary point of the side LNG exchanger 70 and expanding it using turbine 80. The exhaust gas of the turbine 49, which is now colder, would be sent back to the side LNG exchanger 70 to provide additional refrigeration in the side LNG exchanger 70. The turbine 80 can be coupled with an oil or air break, a generator or natural gas booster 85.

With this arrangement, the medium pressure nitrogen cold stream temperature is removed from the medium pressure column at a temperature that is warm enough so that there is little to no risk of hydrocarbon freezing in the side LNG exchanger 70.

This embodiment allows coproduction of LNG with an Air Separation Unit with a low CAPEX as the liquefaction part includes an exchanger that can be of the following types (non exhaustive):

Brazed Aluminum
Spiral coil
Channeled plate

As before, the LPGAN 55 exiting the side LNG exchanger can be used for the regeneration of the natural gas purification, for the regeneration of the ASU purification, and/or can be sent to the chiller tower of the ASU.

This option is applicable to all ASU process cycles as well as liquefiers when a cold enough stream is available.

Figure 1:
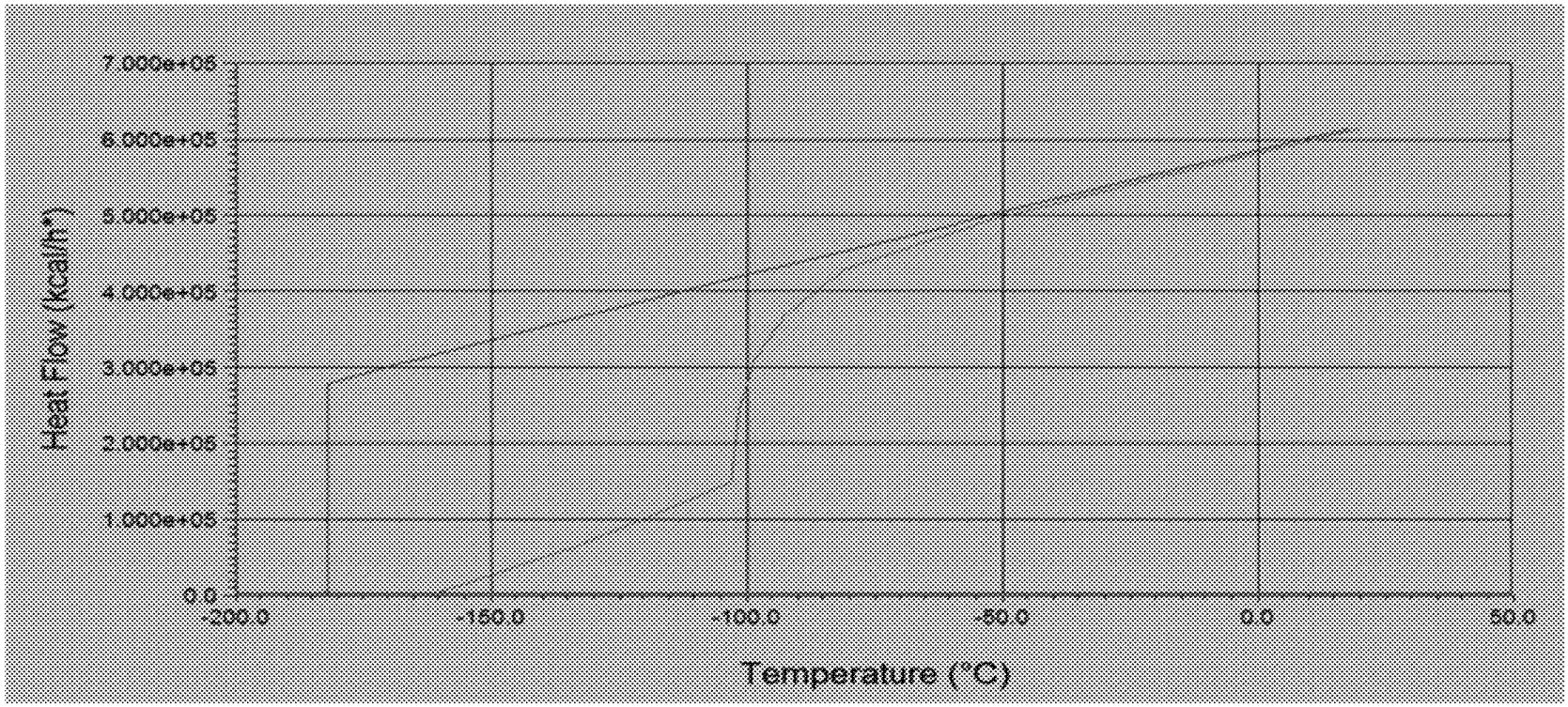
FIG. 1 (PRIOR ART)
FIG. 1 provides a graphical representation showing the irreversible heat losses for liquefying natural gas using methods known in the prior art.
Figure 5:
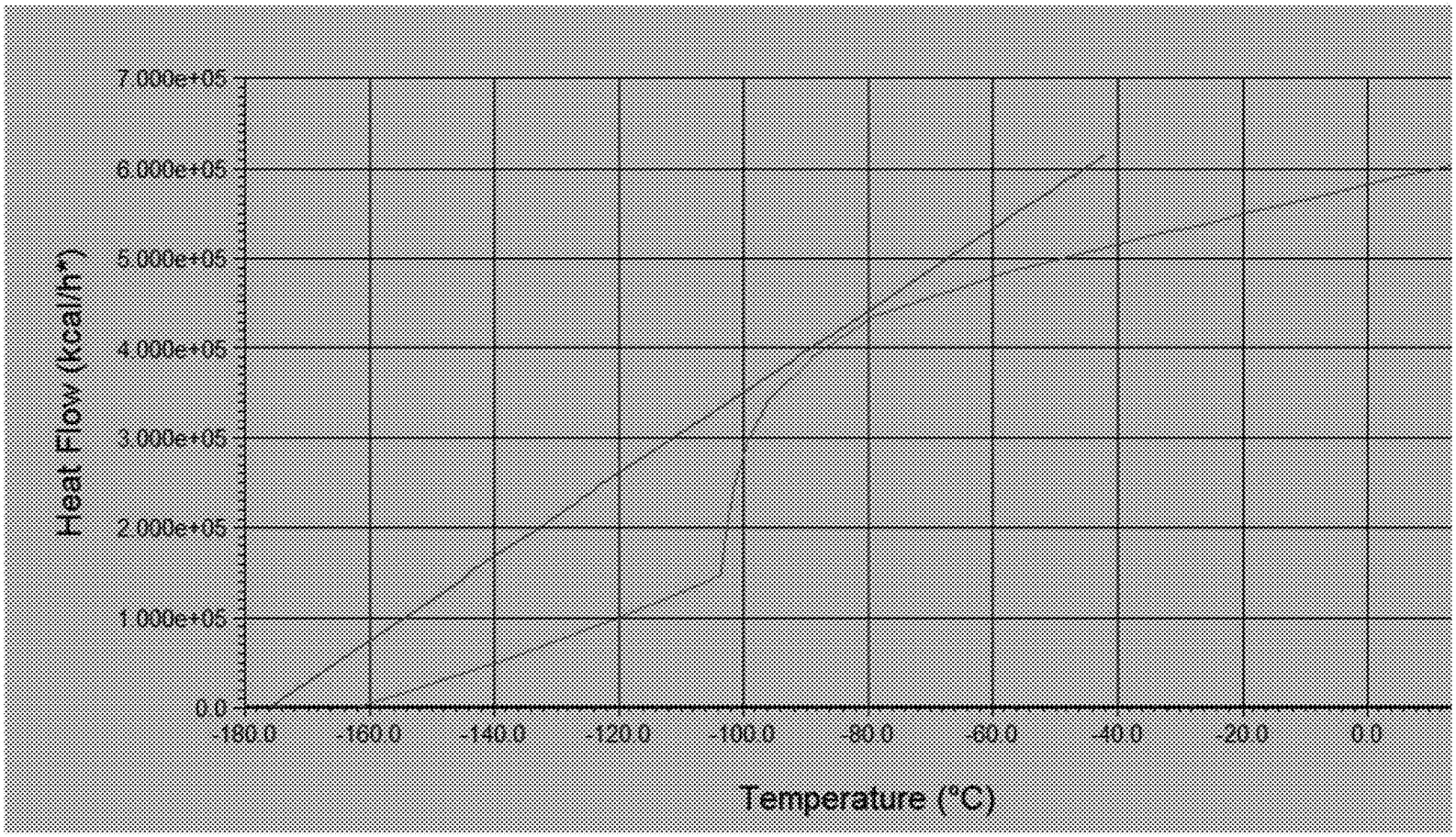
FIG. 5 provides a graphical representation showing the irreversible heat losses for liquefying natural gas based on the embodiment shown in FIG. 3.
Figure 6:
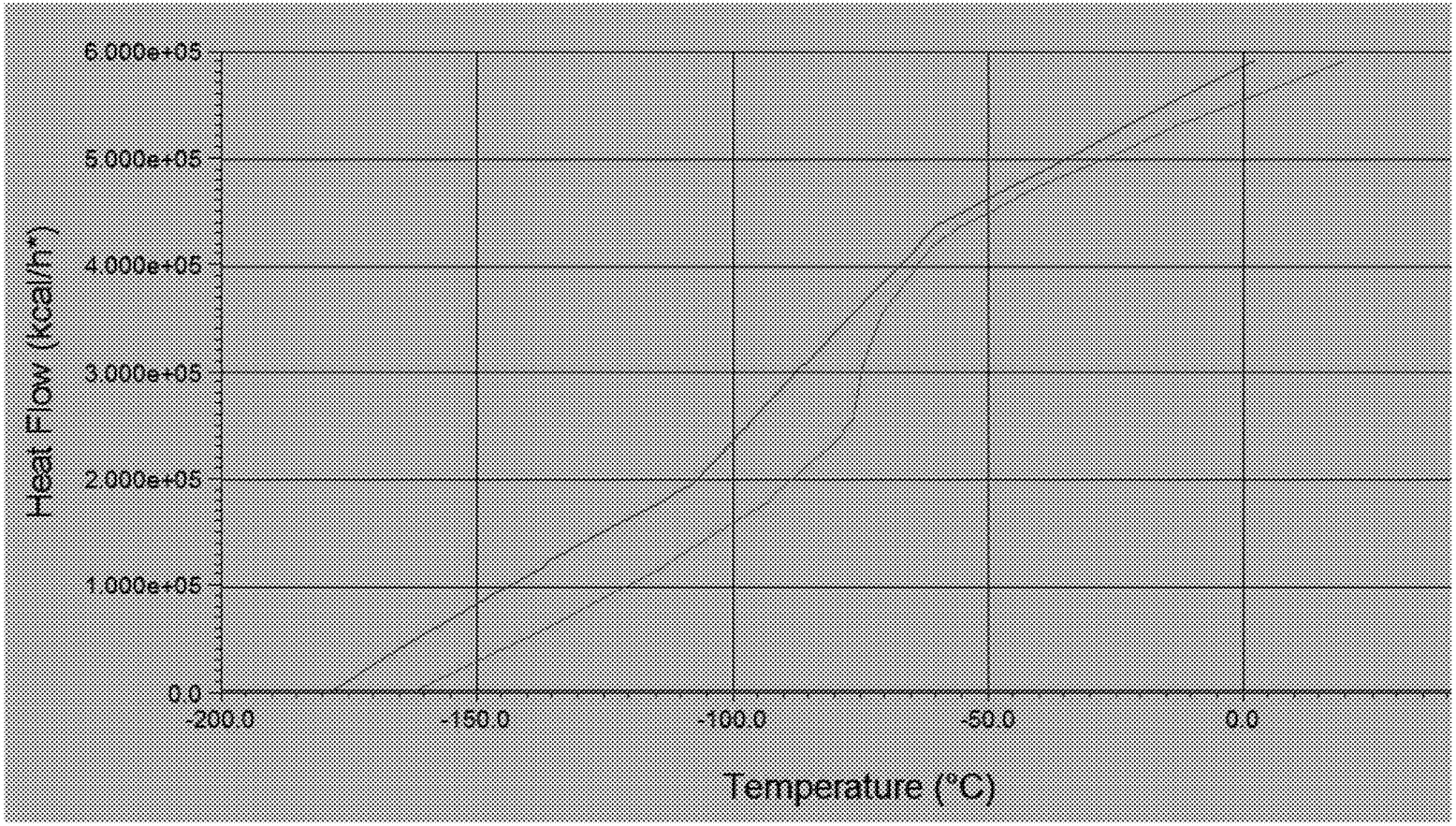
FIG. 6 provides a graphical representation showing the irreversible heat losses for liquefying natural gas based on the embodiment shown in FIG. 4.

FIG. 5 provides a graphical representation showing the irreversible heat losses for the embodiment shown in FIG. 3. Similarly, FIG. 6 provides a graphical representation showing the irreversible heat losses for the embodiment shown in FIG. 4. As is clearly shown, the irreversible heat losses for FIGS. 5 and 6 are clearly improved as compared to that shown in FIG. 1 (e.g., using liquid nitrogen as a refrigerant to liquefy natural gas). Moreover, the embodiment shown in FIG. 4 that includes the medium pressure nitrogen provides additional energy improvements as compared to the embodiment in which low pressure waste nitrogen is used.

Working Example

The table below provides comparison data for the relative power used for three different setups. The first column represents the prior art method of vaporizing liquid nitrogen from a liquid nitrogen storage tank, while the second and third columns represent the embodiments shown in FIGS. 3 and 4, respectively. As can be seen, the embodiments of the present invention provide a 20% and 30% improvement over the prior art.

TABLE 1

| Comparative Data | | | |
|---|---|---|---|
| | Direct LIN vaporization | Waste Nitrogen or low pressure nitrogen to LNG | Cold Medium pressure GAN |
| Relative specific power to produce LNG | 100% | 80% | 70% |

Those of ordinary skill in the art will recognize that embodiments of the invention provide an innovative approach and effective strategy for solving the current limitations of today's technology. While the embodiments shown herein show the use of an ASU to provide the low pressure and high pressure nitrogen streams, those of ordinary skill in the art will recognize that the invention is not so limited. Rather, certain embodiments of the invention can also include other types of cryogenic sources of nitrogen, such as a nitrogen liquefier. Similarly, the invention is not limited to the specific arrangement of turbines and boosters in the ASU shown herein. Rather, certain embodiments of the invention can be applied to having a natural gas liquefier in conjunction with an ASU that has an available cold gas stream available, particularly a gas stream at about −155° C. to about −193° C.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, language referring to order, such as first and second, should be understood in an exemplary sense and not in a limiting sense. For example, it can be recognized by those skilled in the art that certain steps can be combined into a single step.

The singular forms "a", "an", and "the" include plural referents, unless the context clearly dictates otherwise.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

We claim:

1. A method for producing liquefied natural gas, the method comprising the steps of:

rectifying air in a double column system comprising a higher pressure column and a lower pressure column thermally linked by a common condenser-reboiler thereby producing a low pressure nitrogen stream in a top portion of the lower pressure column, an oxygen stream in a lower portion of the lower pressure column, and a medium pressure nitrogen stream in an upper portion of the higher pressure column;

introducing the medium pressure nitrogen stream to a natural gas liquefaction unit;

withdrawing the medium pressure nitrogen stream from the natural gas liquefaction unit from an intermediate location;

expanding the medium pressure nitrogen stream in a nitrogen turbine to form an expanded nitrogen stream;

reintroducing the expanded nitrogen stream into the natural gas liquefaction unit to provide additional refrigeration to the natural gas;

compressing a natural gas stream in a natural gas compressor; and liquefying the natural gas stream in the natural gas liquefaction unit against the medium pressure nitrogen stream and the expanded nitrogen stream;

wherein the nitrogen turbine is coupled to the natural gas compressor, wherein the medium pressure nitrogen stream is a gaseous stream when introduced to the natural gas liquefaction unit, wherein there is an absence of vaporization of the medium pressure nitrogen stream within the natural gas liquefaction unit.

2. A method for producing liquefied natural gas, the method comprising the steps of:

withdrawing a nitrogen stream from a cryogenic unit, wherein the nitrogen stream is at a temperature between about −155° C. to about −193° C. and is in gaseous form; and liquefying a natural gas stream in a natural gas liquefaction unit using the nitrogen stream from the cryogenic unit, wherein the cryogenic unit comprises an air separation unit having a double column system comprising a higher pressure column and a lower pressure column thermally linked by a common condenser-reboiler, wherein the double column system is configured to produce a low pressure nitrogen stream in a top portion of the lower pressure column, an oxygen stream a lower portion of the lower pressure column, and the nitrogen stream from an upper portion of the higher pressure column, the double column system, wherein the nitrogen stream is selected from a group consisting of the low pressure nitrogen stream, the medium pressure nitrogen stream, and combinations thereof, wherein the step of liquefying the natural gas stream further comprises warming the medium pressure nitrogen stream in the natural gas liquefaction unit, then withdrawing the medium pressure nitrogen stream from the natural gas liquefaction unit from an intermediate location; expanding the medium pressure nitrogen stream in a nitrogen turbine to form an expanded nitrogen stream; and then reintroducing the expanded nitrogen stream into the natural gas liquefaction unit to provide additional refrigeration to the natural gas, wherein there is an absence of vaporization of the medium pressure nitrogen stream within the natural gas liquefaction unit.

3. The method as claimed in claim 2, further comprising the step of compressing the natural gas stream in a natural gas compressor prior to liquefying the natural gas stream in the natural gas liquefaction unit.

4. The method as claimed in claim 3, wherein the nitrogen turbine is coupled to the natural gas compressor.

5. The method as claimed in claim 1, wherein the expanded nitrogen stream, after warming, is withdrawn from the natural gas liquefaction unit and is used for regeneration of a natural gas purification unit.

6. The method as claimed in claim 1, wherein the expanded nitrogen stream, after warming, is withdrawn from the natural gas liquefaction unit and is used for regeneration of a purification unit disposed upstream the double column system.

7. The method as claimed in claim 1, wherein the expanded nitrogen stream, after warming, is withdrawn from the natural gas liquefaction unit and is sent to a chiller tower disposed upstream of the double column system.

* * * * *